US006074808A

United States Patent [19]

Endo

[11] Patent Number: 6,074,808

[45] Date of Patent: Jun. 13, 2000

[54] EMULSIFIED DISPERSION

[75] Inventor: Kiyoshi Endo, Hino, Japan

[73] Assignee: Konica Corporation, Japan

[21] Appl. No.: 09/390,916

[22] Filed: Sep. 7, 1999

[30] Foreign Application Priority Data

Sep. 10, 1998 [JP] Japan ..... 10-272474

[51] Int. Cl.[7] ..... G03C 1/38

[52] U.S. Cl. ..... 430/546

[58] Field of Search ..... 430/546

[56] References Cited

U.S. PATENT DOCUMENTS

| | | | |
|---|---|---|---|
| 5,582,960 | 12/1996 | Nielson et al. | 430/546 |
| 5,589,322 | 12/1996 | Lobo et al. | 430/546 |
| 5,674,666 | 10/1997 | Lau et al. | 430/546 |
| 5,827,452 | 10/1998 | Young | 430/546 |
| 5,879,870 | 3/1999 | Rosiek et al. | 430/546 |
| 5,981,159 | 11/1999 | Nielsen et al. | 430/546 |
| 5,998,120 | 12/1999 | Connelly et al. | 430/546 |

*Primary Examiner*—Hoa Van Le
*Attorney, Agent, or Firm*—Jordan B. Bierman; Bierman, Muserlian and Lucas

[57] ABSTRACT

An emulsified dispersion comprising at least a photographically useful hydrophobic substance and at least a high boiling solvent, further said emulsified dispersion substantially not comprising an auxiliary organic solvent, wherein a solubility parameter of said photographically useful hydrophobic substance at a temperature of 25° C., and a solubility parameter of said high boiling solvent at a temperature of 25° C. satisfies the relationship represented by the following Formula (1), and said photographically useful hydrophobic substance is dissolved in said high boiling solvent, $$\sum_{i=1}^{n} (|AiSP - HBSiSP| \times \Phi Ai) \leq 1.0 \qquad \text{Formula (1)}$$

AiSP: a solubility parameter of a photographically useful hydrophobic substance, Ai, at a temperature of 25° C.

HBSiSP: a solubility parameter of a high boiling solvent, HBSi, at a temperature of 25° C.

ϕAi: a proportion based on the volume fraction of a photographically useful hydrophobic substance, Ai, in an oil phase at a temperature of 25° C.

5 Claims, No Drawings

EMULSIFIED DISPERSION

FIELD OF THE INVENTION

The present invention relates to an emulsified dispersion comprising photographically useful hydrophobic substances such as a color image forming compound, compounds used in a diffusion transfer system, an antioxidant, an anti-color contamination agent, an ultraviolet ray absorbent, a whitening agent, or the like, and further to an oil-in-water type emulsified dispersion comprising said photographically useful hydrophobic compounds.

BACKGROUND OF THE INVENTION

In a photographic light-sensitive material, the photographically useful hydrophobic substances, such as a color image forming compound (hereinafter referred to as a coupler), compounds used in a diffusion transfer system, an antioxidant (an anti-color fading agent, a color image stabilizer), an anti-color contamination agent (an anti-color foggant), an ultraviolet ray absorbent, a whitening agent, a high boiling solvent, or the like, are usually used in the form of an oil-in-water type emulsified dispersion.

In a conventional emulsifying method for preparing said oil-in-water type emulsified dispersions of those substances, the following processes are employed: (i) an oil phase solution is prepared by mixing and dissolving hydrophobic substances and a high boiling solvent by the use of an auxiliary organic solvent; (ii) a water phase solution is prepared by the use of a water-soluble binder such as gelatin and an emulsifying agent; (iii) said oil phase solution is added to said water phase solution to be mixed to produce an oil-in-water type emulsified dispersion containing said hydrophobic substances in an oil phase; (iv) said oil-in-water type emulsified dispersion is further dispersed by the use of a disperser such as a colloidal mill, a homogenizer, a homomixer or the like, to provide oil droplets containing said hydrophobic substances at a desired size. In the photographic art, said oil droplet size usually results in between 0.1 and 0.3 $\mu$m.

In general, the auxiliary organic solvent used for preparing the emulsified dispersion of the photographically useful hydrophobic substances is removed to enhance photographic characteristics, as well as coatability, however, it takes a long time to remove the auxiliary organic solvent and the cost, necessary for providing facilities to remove it, is excessive.

Over recent years, with ever-increasing environmental concerns, reducing the amount of the auxiliary organic solvents used in producing the photographic light-sensitive materials, has been a major factor. Accordingly, the use of the auxiliary organic solvent in preparing the above-mentioned oil-in-water type emulsified dispersion is critical and reducing the used amount of the auxiliary organic solvent is an inherent problem.

However, there occur various problems when preparing the oil-in-water type emulsified dispersion without the use of said auxiliary organic solvent.

When an oil phase composition used in preparing the oil-in-water type emulsified dispersion is provided without the use of the auxiliary organic solvent, there occur various problems unless the oil phase composition is melted at 100 to 150° C. Therefore, the oil-in-water type emulsified dispersion is usually produced by melting the oil phase composition by heating it from 100 to 150° C. In fact, melting the oil phase composition by heating it to not less than 100° C. is disclosed in U.S. Pat. No. 5,589,322.

However, even when the oil phase composition is obtained by heating it at a high temperature, the photographically useful hydrophobic compounds occasionally precipitate during the dispersion process, as well as during storage of the dispersing solution, to result in deteriorated coatability and other undesirable photographic characteristics.

SUMMARY OF THE INVENTION

Accordingly, an object of the present invention is to provide an-emulsified dispersion which does not cause precipitation of the photographically useful hydrophobic compounds, without the use of the auxiliary organic solvent.

DETAILED DESCRIPTION OF THE INVENTION

The above-mentioned object of the present invention is attained by the following constitution.

(1) An emulsified dispersion comprising at least a photographically useful hydrophobic substance and at least a high boiling solvent, further said emulsified dispersion substantially not comprising an auxiliary organic solvent, wherein a solubility parameter of said photographically useful hydrophobic substance at a temperature of 25° C., and a solubility parameter of said high boiling solvent at a temperature of 25° C. satisfies the relationship represented by the following Formula (1), and said photographically useful hydrophobic substance is dissolved in said high boiling solvent, $$\sum_{i=1}^{n} (|AiSP - HBSiSP| \times \Phi Ai) \leq 1.0 \qquad \text{Formula (1)}$$

AiSP: a solubility parameter of a photographically useful hydrophobic substance, Ai, at a temperature of 25° C.

HBSiSP: a solubility parameter of a high boiling solvent, HBSi, at a temperature of 25° C.

$\phi$Ai: a proportion based on the volume fraction of a photographically useful hydrophobic substance, Ai, in an oil phase at a temperature of 25° C.

(2) The emulsified dispersion of item 1, wherein $\phi$Ai satisfies the relationship represented by the following Formula (2), $$\phi Ai \leqq (-0.9/5) \times |AiSP - HBSiSP| + 1.0 (0 < \phi Ai < 1) \qquad \text{Formula (2)}$$

(3) The emulsified dispersion of item 2, wherein $\phi$Ai satisfies the relationship represented by the following Formula (3), $$\phi Ai \leqq (-0.9/5) \times |AiSP - HBSiSP| + 1.0 (0 < \phi Ai < 0.7) \qquad \text{Formula (3)}$$

(4) The emulsified dispersion of item 1, wherein i is an integer of not less than 2.

(5) The emulsified dispersion of item 1, wherein said emulsified dispersion is prepared in the presence of an anionic surfactant and/or a nonionic surfactant.

The present invention will now be detailed below.

First, the above-mentioned photographically useful hydrophobic substance will be detailed below.

Examples of the above-mentioned photographically useful hydrophobic substances used for preparing the oil-in-water type emulsified dispersion include, for example, a color image forming compound (a coupler, etc.), compounds used in a diffusion transfer system, an antioxidant (an anti-color fading agent, a color image stabilizer), an anti-color contamination compound (an anti-color foggant), an ultraviolet rays absorbent, a whitening agent, a high boiling solvent, or the like.

"Coupler" is the generic term for an image forming compound which reacts with an oxidized product of an aromatic amine (usually, a primary amine is used) to produce a dye, and the coupler used in the present invention is a nondiffusion type coupler having a so-called ballast group in its molecule. There are a 2-equivalent type coupler and a 4-equivalent type coupler, and both types of couplers may be used in the present invention.

There are also various types of couplers other than the above-mentioned couplers, namely, a colored coupler having color correction effects and couplers which release photographically useful fragments such as a development inhibitor and a development accelerator, etc., (e.g. a DIR coupler, a super DIR coupler, a DAR coupler, and a DTR coupler), a non-dye forming coupler, a DIR coupler capable of cleaving on oxidative reaction, a timing DIR coupler, a coupler capable of producing a smearing dye, a competing coupler, and a polymer coupler (a polymer coupler in which at least dimer of couplers are polymerized, a polymer coupler in which at least one coupler is organic chemically joined in pendant state to an organic high molecular chain).

Examples of the compounds used in a diffusion transfer system include a dye-developer capable of releasing diffusible dye (DDR compound), a diffusible dye releasing reducing agent (DRR compound), and the like.

When the antioxidant is used for the purpose of anti-color fading, it is termed an anti-color fading agent. The anti-color fading agent is a kind of color image stabilizers.

Examples of the anti-color fading agent include hydroquinone derivatives, 6-hydroxychroman derivatives, 5-hydroxycoumaran derivatives, spirochroman derivatives, p-alkoxyphenol derivatives, hindered phenol derivatives such as bisphenol derivatives, gallic acid derivatives, methylenedioxybenzene derivatives, aminophenol derivatives, hindered amine derivatives, and ether or ester derivatives derived through silylation or alkylation of a phenolic hydroxyl group of these hindered amine derivatives.

Both the anti-color foggants and anti-color contamination compounds react with an oxidized developing agent (quinonediimine, etc.) to deactivate said oxidized developing agent.

Examples of the anti-color foggant or the anti-color contamination compound include hydroquinone derivatives (non-diffusible alkylhydroquinone derivatives, etc.), aminophenol derivatives, amine derivatives, catechol derivatives, non-dye forming couplers, sulfonamidephenol derivatives, gallic acid derivatives and ascorbic acid derivatives.

Examples of the ultraviolet ray absorbent include benzotriazole compounds substituted with an aryl group, 4-thiazolidone derivatives, benzophenone derivatives, cinnamic acid ester derivatives, butadiene derivatives, benzoxazole derivatives, or the like.

Examples of the whitening agent include stilbene derivatives, triazine derivatives, oxazole derivatives and coumarin derivatives.

The photographically useful hydrophobic substances may be used singly or in combination of two kinds or more.

The photographically useful hydrophobic substances of the present invention are dissolved in a high boiling solvent to obtain an oil phase solution. The temperature at which said photographically useful hydrophobic substances are melted is not limited, as long as said photographically useful hydrophobic substances are melted, however, in view of the decomposition of effective components, said temperature is preferably not above 180° C. When said photographically useful hydrophobic substances are melted, a melting stabilizer described in Japanese Patent Application No. 9-366148 (e.g. phenol type antioxidants, amine type antioxidants, higher alcohols, fatty acid esters, or the like) may be added to the oil phase solution.

The boiling point of high boiling solvents used in the present invention is usually not lower than 160° C. Examples of said high boiling solvents include phthalic acid alkyl esters (dibutylphthalate, dioctylphthalate, etc.), phosphoric acid esters (diphenylphosphate, tricresylphosphate, etc.), citric acid esters (acetylcitric acid tributyl ester, etc.), benzoic acid esters (octyl benzoate, etc.), alkylamides (diethyllauryl amide, etc.), and fatty acid esters (dioctyl acetate, etc.).

Said obtained oil phase composition containing the photographically useful hydrophobic substances is added to a water phase solution to prepare an oil-in-water type emulsified dispersion in a common emulsifying manner. A water soluble binder and/or an emulsifying agent is preferably contained in said water phase solution. Further, said emulsifying agent may be contained in said oil phase composition containing the photographically useful hydrophobic substances. The photographically useful hydrophobic substances may be used in combination of two or more kinds, in accordance with their desired function purposes.

An emulsified dispersion of the present invention can be obtained by emulsion dispersion, employing a disperser such as a homomixer, homogenizer, or the like. Said emulsified dispersion can be obtained by a phase inversion method, while the water phase solution is added to the oil phase solution and while the resulting mixture is stirred. To obtain fine oil droplet particles, said phase inversion method is preferably employed. The particle size of said oil droplets is not more than 0.5 $\mu$m, and is preferably not more than 0.3 $\mu$m. In the present invention, "said emulsified dispersion substantially not comprising an auxiliary organic solvent" means that said emulsified dispersion comprises said auxiliary organic solvent in an amount of not more than 1% by weight to the total amount of said emulsified dispersion. Further, in the present invention, "said photographically useful hydrophobic substance is dissolved in said high boiling solvent" means that said photographically useful hydrophobic substance is incorporated through solution in said high boiling solvent.

In the case of using an auxiliary organic solvent in dissolving the photographically useful hydrophobic substances, it is preferable that the amount of said auxiliary organic solvent used is as small as possible, from the viewpoint of environmental concerns. The emulsified dispersion of the present invention can be obtained by the use of said auxiliary organic solvent, however, said emulsified dispersion of the present invention obtained without the use of the auxiliary organic solvent can cause less precipitation of the photographically useful hydrophobic substances. Avoidance of the auxiliary organic solvent leads to less environmental pollution caused by volatilization of the auxiliary organic solvent.

The boiling point of the above-mentioned auxiliary organic solvent is usually between 30 to 150° C. Examples of said auxiliary organic solvent include lower alkyl acetate (ethyl acetate, butyl acetate, etc.), ethyl propionate, secondary butylalcohol, methyl iso-butyl ketone, cyclohexanone, etc. Said auxiliary organic solvent is removed by distillation under reduced pressure and by ultrafiltration after preparing the emulsified dispersion. Said auxiliary organic solvent is used for acceleration of dissolving said photographically useful hydrophobic substances, however, it is preferable not to use said auxiliary organic solvent from the viewpoint of environmental and sanitary concerns.

Examples of a water soluble binder used in preparing emulsified dispersion include gelatin, gelatin derivatives, grafted polymers derived through reaction of gelatin with other high polymers; protein such as albumin, casein, etc.; cellulose derivative such as hydroxymethylcellulose, carboxymethylcellulose and cellulosesulfuric acid esters; sugar derivatives such as sodium alginate and starch derivatives; various kinds of synthesized hydrophilic homopolymers such as polyvinylalcohol, partially acetal modified polyvinylalcohol, poly-N-vinylpyrrolidone, polyacrylic acid, polymethacrylic acid, polyacrylamide, polyvinylimidazole, polyvinylpyrazole; and various kinds of synthesized hydrophilic copolymers.

In preparing an emulsified dispersion, a surfactant can be advantageously employed as an emulsifying agent to attain the objective of the present invention. Examples of said emulsifying agent include nonionic surfactants such as saponin (steroid type), alkylene oxide derivatives (e.g. polyethylene glycol, condensed compounds derived through condensation of polyethylene glycol with polypropylene glycol, polyethylene glycolalkyl or polyethylene glycolarylether, polyethylene glycol ester, polyethylene glycol sorbitan ester, polyalkylene glycol alkylamine or polyalkylene glycol alkylamide, and polyethylene oxide adduct of silicone), glycidol derivatives (e.g. alkenylsuccinic acid polyglyceride, alkylphenol polyglyceride), esters derived from polyhydric alcohol and fatty acid, alkyl ester of sugar, and urethane or ether of sugar; anionic surfactants containing a carboxy group, a sulfo group, a phospho group, a sulfuric acid ester group, and a phophoric acid ester group, such as triterpenoid-saponin, alkylcarboxylic acid salt, alkylsulfuric acid salt, alkylbenzenesulfonic acid salt, alkylnaphthalenesulfonic salt, alkylsulfuric acid ester, alkylphosphoric acid ester, N-acyl-N-taurine, sulfosuccinic acid ester, sulfoalkyl polyoxyethylenealkyl phenylether, and polyoxyethylenealkyl phosphoric acid ester; amphoteric surfactants such as amino acid, aminoalkylsulfonic acid, aminoalkyl sulfuric acid or phosphoric acid, alkylbetaine, amineimide and amineoxide; cationic surfactants such as alkylamine salt, aliphatic or aromatic quarternary ammonium salt, heterocyclic (e.g. pyridinium, imidazolium) quarternary ammonium salt, and phosphonium or sulfonium salt containing an aliphatic group or a heterocyclic group. Of these, the preferable surfactants are anionic surfactants or nonionic surfactants. By combined usage of these anionic surfactant and nonionic surfactant, the producion of fine particles of oil droplets of the photographically useful hydrophobic substances, and prevention of precipitation of the photographically useful hydrophobic substances can be advantageously attained.

Other examples of the above-mentioned hydrophobic substances, auxiliary organic solvents, emulsifying surfactants and water soluble binders are described in Research Disclosure (RD) 308119 (1989), pages 998 through 1011, RD 17643 (1978), pages 24 through 27, RD 18716 (1979), pages 650, 651, RD 17343 (1978), page 25; Japanese Patent Publication Open to Public Inspection Nos. 4-114154, 6-67388, 4-81847, 3-174150, 1-196049, 4-133056, 1-250944, 4-1633, 5-165144, 64-26854, 64-90445, 62-182741, and 64-66646; U.S. Pat. No. 4,774,187; J. Am. Oil. Chem. Soc. 54, 110 (1977).

In the present invention, the solubility parameter of the photographically useful hydrophobic substance at a temperature of 25° C., and the solubility parameter of the high boiling solvent at a temperature of 25° C. satisfy the relationship represented by the following Formulas (1) and/or (2).

$$\sum_{i=1}^{n} (|AiSP - HBSiSP| \times \Phi Ai) \leq 1.0 \qquad \text{Formula (1)}$$

AiSP: a solubility parameter of a photographically useful hydrophobic substance, Ai, at a temperature of 25° C.

HBSiSP: a solubility parameter of a high boiling solvent, HBSi, at a temperature of 25° C.

ϕAi: a proportion based on volume fraction of a photographically useful hydrophobic substance, Ai, in an oil phase at a temperature of 25° C.

$$\phi Ai \leqq (-0.9/5) \times |AiSP - HBSiSP| + 1.0 (0 < \phi Ai < 1) \qquad \text{Formula (2)}$$

AiSP: a solubility parameter of a photographically useful hydrophobic substance, Ai, at a temperature of 25° C.

HBSiSP: a solubility parameter of a high boiling solvent HBSi, at a temperature of 25° C.

ϕAi: a proportion based on volume fraction of a photographically useful hydrophobic substance, Ai, in an oil phase at a temperature of 25° C.

A solubility parameter (hereinafter referred to as SP) used in the present invention is a value for solubility at a temperature of 25° C., obtained through the calculation based on the definition described in Polymer Handbook 2nd Edition, IV-340 (1975), and Polym. Eng. Sci., 147, 14 (2), 1974.

In Formula (1), |AiSP−HBSiSP| (hereinafter referred to as ΔSP) is the absolute value of the remainder, obtained by subtracting SP of a photographically useful hydrophobic substance, Ai (AiSP), used, from SP of the high boiling solvent (HBSiSP). When plural high boiling solvents are used, SP is obtained according to the following procedures; multiplying SP of each high boiling solvent, HBSi, by a proportion based on the volume fraction of each high boiling solvent, HBSi; and by totaling the thus obtained value of each high boiling solvent. Herein, a proportion based on the volume fraction is obtained by dividing the volume of the high boiling solvent, HBSi, by the total volume of the high boiling solvents, HBSs, at a temperature of 25° C., and said proportion is further illustrated by the following formula.

Proportion based on the volume fraction=volume of HBSi/total volume of HBSs.

ϕAi represents a proportion based on the volume fraction of a photographically useful hydrophobic substance, Ai, used in an oil phase at a temperature of 25° C. Herein, a proportion based on the volume fraction is obtained by dividing the volume of the photographically useful hydrophobic substance (PUHS), Ai, by the sum total of the total volume of each HBS and the total volume of each PUHS at a temperature of 25° C., and illustrated by the following formula.

ϕAi=volume of PUHS Ai/(total volume of PUHSs+total volume of HBSs)

In the present invention, the value obtained by the following formula (hereinafter referred to as ΔH), $$\sum_{i=1}^{n} (|AiSP - HBSiSP| \times \Phi Ai),$$

is not more than 1.0, and is preferably not more than 0.9, and is more preferably not more than 0.7. When plural PUHSs are employed, ΔSP is preferably not more than 5.0 for each PUHS Ai.

|AiSP−HBSiSP| in Formula (2) is identical to |AiSP−HBSiSP| as defined in Formula (1), and ϕAi in Formula (2) is also identical to ϕAi as defined in Formula (1).

In the present invention, the value of ϕAi must be less than the value obtained according to the following formula;

$$(-0.9/5)\times|AiSP-HBSiSP|+1.0$$

When plural PUHSs are employed, ϕAi of each PUHS must satisfy the relationship represented by Formula (2). Further, when plural PUHSs are employed, ΔSP is preferably not more than 5.0 for each PUHS Ai.

EXAMPLES

The present invention will now be detailed below with reference to specific Examples, but the present invention is not limited thereto.

Example 1

Preparation of Dispersion A

An oil phase solution, which was obtained by dissolving 95 g of compound A in 50 g of HBS-1 at 150° C., was mixed with 225 ml of 10% gelatin aqueous solution containing 5 g of surfactant-1, and the thus obtained mixture was subjected to emulsion dispersion employing a homomixer for 30 min. at 10,000 rpm. Thus, Dispersion A was obtained.

ΔSP of compound A was 1.72 and calculated ΔH obtained for said compound A was 1.21.

Preparation of Dispersion B

Dispersion B was obtained in the same manner as that employed for preparing Dispersion A except that 95 g of compound A used in preparing Dispersion A was replaced with 70 g of compound A.

Preparation of Dispersion C

Dispersion C was obtained in the same manner as that employed for preparing Dispersion A except that 95 g of compound A used in preparing Dispersion A was replaced with 62 g of compound A.

Preparation of Dispersion D

Dispersion D was obtained in the same manner as that employed for preparing Dispersion A except that HBS-1 used in preparing Dispersion A was replaced with HBS-2.

Preparation of Dispersion E

An oil phase solution, which was obtained by dissolving 52 g of compound A and 10 g of compound B in 50 g of HBS-1 at 150° C., was then mixed with 225 ml of 10% gelatin aqueous solution containing 5 g of surfactant-1, and the thus obtained mixture was subjected to emulsion dispersion employing a homomixer for 30 min. at 10,000 rpm. Thus, Dispersion E was obtained.

Preparation of Dispersion F

Dispersion F was obtained in the same manners as those employed for preparing Dispersion E except that HBS-1 used in preparing Dispersion E was replaced with HBS-3.

Preparation of Dispersion G

Dispersion G was obtained in the same manner as that employed for preparing Dispersion F except that 40 g of compound A used for preparing Dispersion F was replaced with 2 g of compound B.

The thus obtained Dispersions A through G were evaluated according to the following method. The obtained results are shown in Table 1.

Evaluation of Precipitation 100 g of dispersion was filtrated by means of suction employing a 3 μm membrane filter, after which residual precipitation on said filter was observed with an optical microscope (magnified at 400 times). At that time, 100 ares were observed. Evaluation was conducted based on the following criteria.

Evaluation Criteria

1: Precipitation was observed in not less than 20 areas
2: Precipitation was observed in between 6 to 19 areas
3: Precipitation was observed in between 1 and 5 areas
4: No precipitation was observed

TABLE 1

| Dispersion | Compound (hydrophobic substance) | ΔSP | ΔH [the left side of Formula (1)] | Results of precipitation evaluation | |
|---|---|---|---|---|---|
| A | A | 1.72 | 1.21 | 1 | Comp. |
| B | A | 1.72 | 0.94 | 3 | Inv. |
| C | A | 1.72 | 0.89 | 4 | Inv. |
| D | A | 0.85 | 0.56 | 4 | Inv. |
| E | A | 1.72 | 0.99 | 2 | Inv. |
| | B | 3.28 | | | |
| F | A | 3.45 | 1.33 | 1 | Comp. |
| | B | 5.01 | | | |
| G | A | 3.45 | 0.99 | 2 | Inv. |
| | B | 5.01 | | | |

Comp.: Comparison; Inv.: Invention

As can be seen from Table 1, the present inventive dispersions do not result in marked precipitation.

Example 2

The present inventive Dispersions H through K were provided as follows.

Preparation of Dispersion H

An oil phase solution, which was obtained by dissolving 20 g of compound C and 0.05 g of compound D in 10 g of HBS-1 and 10 g of HBS-4 at 150° C., was then mixed with 60 ml of a 10% gelatin aqueous solution containing 1.4 g of surfactant-1, and the thus obtained mixture was subjected to emulsion dispersion employing a homomixer for 30 min. at 10,000 rpm. Thus, dispersion H was obtained.

Preparation of Dispersion I

Dispersion I was obtained in the same manner as that employed for preparing Dispersion H except that 10 g of HBS-1 used for preparing Dispersion H was replaced with 10 g of HBS-4.

Preparation of Dispersion J

Dispersion J was obtained in the same manner as that employed for preparing Dispersion H except that 1.4 g of ethyleneglycol is added to the oil phase of Dispersion H.

Preparation of Dispersion K

To an oil phase obtained by dissolving 20 g of compound C and 0.05 g of compound D in 20 g of HBS-4 at 150° C., was gradually added 60 ml of a gelatin aqueous solution containing 1.4 g of surfactant-1 so that a phase inversion was induced to take place. In making the phase inversion to take place, 7 ml of the gelatin aqueous solution was required and dispersion was conducted employing a homomixer. Thus, Dispersion K was provided.

The precipitation evaluation for the thus obtained Dispersions H through K was conducted in the same manner as that employed for evaluating Dispersions A through G in Example 1. The thus obtained results are shown in Table 2.

TABLE 2

| Dis-persion | Compound (hydrophobic substance) | ΔSP | Proportion based on volume fraction of each compound, ϕAi | The right side of Formula (2) | Results of precipitation evaluation |
|---|---|---|---|---|---|
| H | C | 0.92 | 0.47 | 0.83 | 2 |
| | D | 5.21 | 0.01 | 0.06 | |
| I | C | 0.31 | 0.49 | 0.94 | 3 |
| | D | 4.6 | 0.01 | 0.17 | |
| J | C | 0.92 | 0.46 | 0.82 | 3 |
| | D | 0.52 | 0.01 | 0.05 | |

TABLE 2-continued

| Dis-persion | Compound (hydrophobic substance) | ΔSP | Proportion based on volume fraction of each compound, ϕAi | The right side of Formula (2) | Results of precipitation evaluation |
|---|---|---|---|---|---|
| K | C | 0.31 | 0.49 | 0.94 | 3 |
| | D | 4.6 | 0.01 | 0.17 | |

As can be seen from Table 2, the present inventive dispersions do not result in marked precipitation.

Compounds used in Example 1 and Example 2 are illustrated below.

Compound A

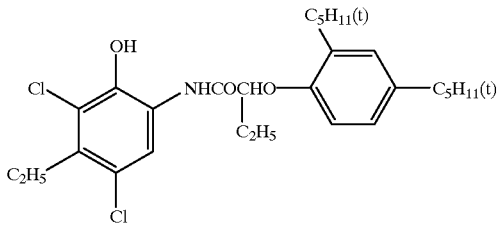

Compound B

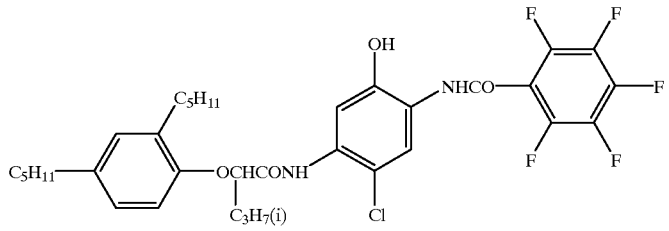

Compound C

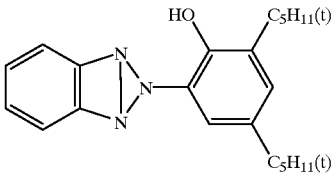

Compound D

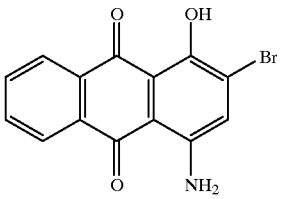

HBS-1

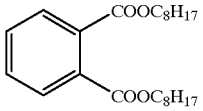

-continued

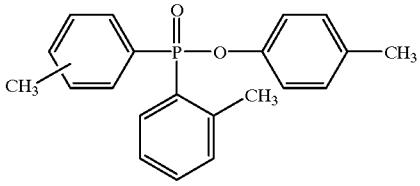

HBS-2

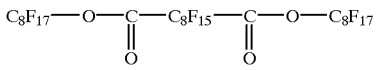

HBS-3

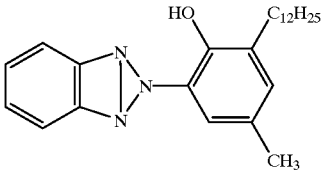

HBS-4

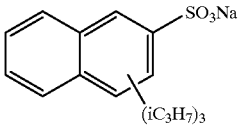

Surfactant-1

What is claimed is:

1. An emulsified dispersion comprising at least a photographically useful hydrophobic substance and at least a high boiling solvent, further said emulsified dispersion substantially not comprising an auxiliary organic solvent, wherein a solubility parameter of said photographically useful hydrophobic substance at a temperature of 25° C., and a solubility parameter of said high boiling solvent at a temperature of 25° C. satisfy the relationship represented by the following Formula (1), and said photographically useful hydrophobic substance is dissolved in said high boiling solvent, $$\sum_{i=1}^{n} (|AiSP - HBSiSP| \times \Phi Ai) \leq 1.0 \qquad \text{Formula (1)}$$

AiSP: a solubility parameter of a photographically useful hydrophobic substance, Ai, at a temperature of 25° C.

HBSiSP: a solubility parameter of a high boiling solvent, HBSi, at a temperature of 25° C.

ϕAi: a proportion based on the volume fraction of a photographically useful hydrophobic substance, Ai, in an oil phase at a temperature of 25° C.

2. The emulsified dispersion of claim 1, wherein ϕAi satisfies the relationship represented by the following Formula (2), $$\phi Ai \leqq (-0.9/5) \times |Aisp - HBSisp| + 1.0 (0 < \phi Ai < 1) \qquad \text{Formula (2).}$$

3. The emulsified dispersion of claim 2, wherein ϕAi satisfies the relationship represented by the following Formula (3), $$\phi Ai \leqq (-0.9/5) \times |Aisp - HBSisp| + 1.0 (0 < \phi Ai < 0.7) \qquad \text{Formula (3).}$$

4. The emulsified dispersion of claim 1, wherein i is an integer of not less than 2.

5. The emulsified dispersion of claim 1, wherein said emulsified dispersion is prepared in the presence of an anionic surfactant and/or a nonionic surfactant.

* * * * *